US007472556B2

(12) United States Patent
Kirby et al.

(10) Patent No.: US 7,472,556 B2
(45) Date of Patent: Jan. 6, 2009

(54) VACUUM INSULATED REFRIGERATOR CABINET AND METHOD FOR ASSESSING THERMAL CONDUCTIVITY THEREOF

(75) Inventors: David Kirby, St. Joseph, MI (US); Luigi Martinella, Ghiffa (IT); Giorgio Giudici, Lonate Pozzolo (IT)

(73) Assignee: Whirlpool Corporation, Benton Harbor, MI (US)

( * ) Notice: Subject to any disclaimer, the term of this patent is extended or adjusted under 35 U.S.C. 154(b) by 625 days.

(21) Appl. No.: 10/519,439

(22) PCT Filed: Jun. 27, 2003

(86) PCT No.: PCT/EP03/06865

§ 371 (c)(1),
(2), (4) Date: Dec. 29, 2004

(87) PCT Pub. No.: WO2004/003446

PCT Pub. Date: Jan. 8, 2004

(65) Prior Publication Data

US 2005/0248249 A1 Nov. 10, 2005

(30) Foreign Application Priority Data

Jul. 1, 2002 (EP) ..... 02014061

(51) Int. Cl.
*F25B 49/00* (2006.01)
*G01K 1/00* (2006.01)

(52) U.S. Cl. ..... 62/132; 62/126; 264/102; 702/130

(58) Field of Classification Search ..... 62/132, 62/126, 45.1, DIG. 13; 220/592.07, 641; 164/102, 138; 264/102, 138; 702/130
See application file for complete search history.

(56) References Cited

U.S. PATENT DOCUMENTS

| | | | | | |
|---|---|---|---|---|---|
| 5,038,304 | A | * | 8/1991 | Bonne | 702/99 |
| 5,361,598 | A | * | 11/1994 | Roseen | 62/229 |
| 5,622,430 | A | * | 4/1997 | Pletka et al. | 374/45 |
| 5,934,085 | A | * | 8/1999 | Suzuki et al. | 62/98 |
| 2003/0046894 | A1 | * | 3/2003 | Scholz | 52/741.3 |

FOREIGN PATENT DOCUMENTS

| | | | |
|---|---|---|---|
| DE | 2365900 | A1 | 9/1976 |
| DE | 10006878 | A1 | 9/2001 |
| EP | 0587546 | A1 | 3/1994 |
| EP | 0633420 | A2 | 1/1995 |

* cited by examiner

*Primary Examiner*—Chen-Wen Jiang
(74) *Attorney, Agent, or Firm*—Kirk Goodwin; Michael D. Lafrenz

(57) ABSTRACT

A vacuum insulated refrigerator cabinet comprises an evacuation system for evacuating an insulation space of the cabinet when pressure inside such space is higher than a predetermined value. It comprises a sensor device having an insulation reference element located on one side of said insulation space and temperature sensors for assessing the differences of temperature across the insulation space) and across the insulation reference element, such sensor device being suitable for providing the evacuation system with a signal related to the ratio of the above differences of temperature.

7 Claims, 1 Drawing Sheet

VACUUM INSULATED REFRIGERATOR CABINET AND METHOD FOR ASSESSING THERMAL CONDUCTIVITY THEREOF

CROSS-REFERENCE TO RELATED APPLICATIONS

The present application is a National stage application of PCT/EP03/06865, filed Jun. 27, 2003.

1. Field of the Invention

The present invention relates to a vacuum insulated refrigerator cabinet comprising an evacuation system for evacuating an insulation space of the cabinet when pressure inside such space is higher than a predetermined value. With the term "refrigerator" we mean every kind of domestic appliance in which the inside temperature is lower than room temperature, i.e. domestic refrigerators, vertical freezers, chest freezer or the like.

2. Discussion of the Prior Art

A vacuum insulated cabinet (VIC) for refrigeration can be made by building a refrigeration cabinet that has a hermetically sealed insulation space and filling that space with a porous material in order to support the walls against atmospheric pressure upon evacuation of the insulation space. A pump system may be needed to intermittently re-evacuate this insulation space due to the intrusion of air and water vapour by permeation. A solution of providing a refrigerator with a vacuum pump running almost continuously is shown in EP-A-587546, and it does increase too much the overall energy consumption of the refrigerator. It is advantageous for energy consumption to re-evacuate only when actually needed. Therefore there is in the art the need of a simple and inexpensive insulation measurement system that would be applicable to operate a refrigerator cabinet vacuum pump or similar evacuation system only when actually needed.

SUMMARY OF THE INVENTION

The present invention provides a vacuum insulated refrigerator cabinet having such insulation measurement system, according to the appended claims. According to the invention the sensor system is a system that compares the insulating value of the vacuum insulated cabinet to a standard insulation. Temperature measurements are made all at the same point on the cabinet. A pad of a material with known properties, preferably a standard non-ageing insulation, covers this point. The insulation performances of such standard insulation do not preferably change with time. Non-ageing insulators would be for instance rigid, open celled PU and rigid glass fibre insulation. Closed cell insulation such as PS or PU is less preferred since their insulation performances may change with age due to change in cell gas composition. The temperature measurements are preferably made at a point on or near the outer surface of the insulation pad, at the interface of the pad and the cabinet liner (or alternatively to the wrapper, i.e. the outside surface of the cabinet) and at a point the opposite side from the pad. The temperature difference across the pad is compared to the temperature difference across the vacuum insulation. When the ratio of the temperature differences changes, it will indicate that the vacuum insulation is deteriorating. A criterion for vacuum pump operation based on this temperature ratio will assure that the insulation is always operating in an efficient manner. The function of the sensor system according to the invention is not affected by changing ambient conditions, as it would be affected a sensor system based on temperature values. Anyway, due to such changing ambient conditions, averages may have to be taken. Any of various temperature measuring devices may be used, some of which can measure the differences directly. Thermocouples and resistance thermometers are useful examples of such devices.

BRIEF DESCRIPTION OF THE DRAWINGS

The invention will now be explained in greater detail with reference to drawings, which show.

DETAILED DESCRIPTION OF THE PREFERRED EMBODIMENT

Figure 1:
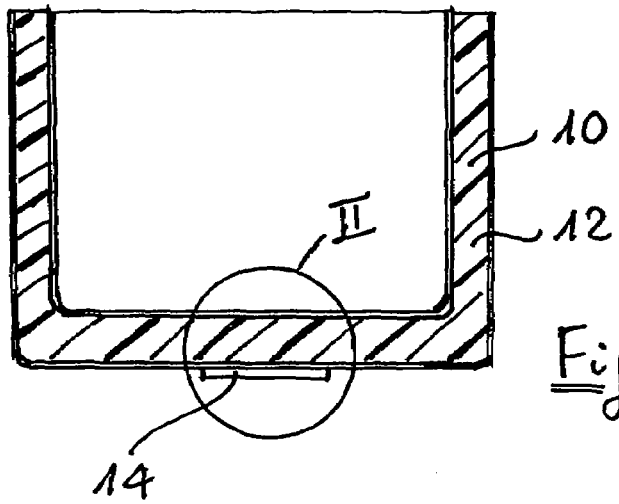
FIG. 1 is a schematic cross-view of a vacuum insulated cabinet according to the invention.
Figure 2:
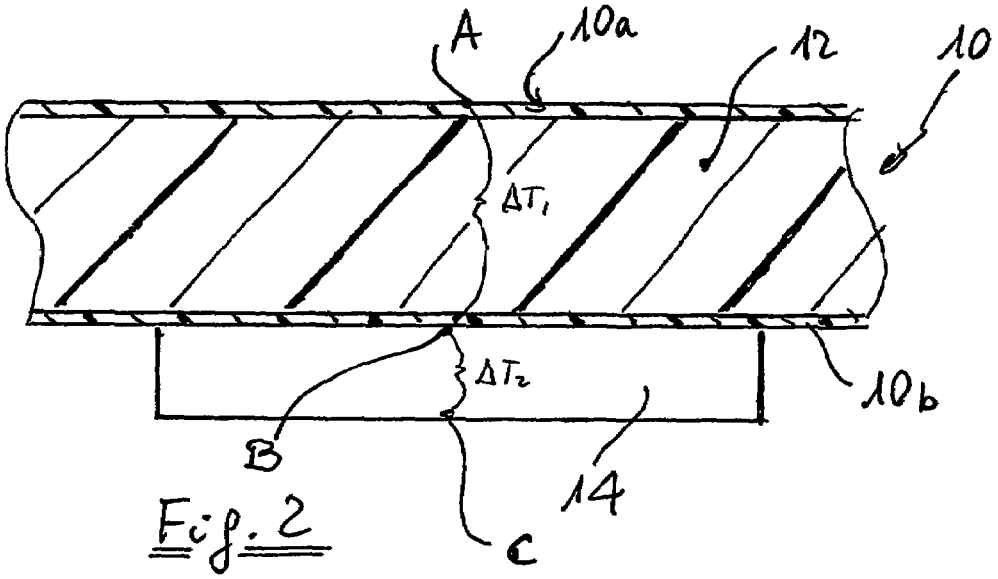
FIG. 2 is an enlarged view of a detail of FIG. 1.

With reference to FIGS. 1 and 2, a refrigerator cabinet comprises a insulated double wall 10 comprising two relatively gas impervious walls 10*a* (liner) and 10*b* (wrapper) filled with an insulation material 12 that can be evacuated. Both liner 10*a* and wrapper 10*b* may be of polymeric material. The insulation material 12 can be an inorganic powder such as silica and alumina, inorganic and organic fibres, an injection foamed object of open-cell or semi-open-cell structure such as polyurethane foam, or a open celled polystyrene foam that is extruded as a board and assembled into the cabinet. The insulation material 12 is connected to a known evacuation system (not shown) that can be a physical adsorption stage (or more stages in series) or a mechanical vacuum pump or a combination thereof.

According to the invention, on the wrapper 10*b* of the double wall 10 it is glued or soldered an insulation pad 14 of a standard, non-ageing insulation, for instance a rigid glass fibre pad. Temperature sensors, such as thermocouples, are placed at points A, B and C of FIG. 2 and they are connected to a central process unit of the appliance (not shown) in order to provide it with a ratio $\Delta T_1/\Delta T_2$ between temperature difference across points A, B and B, C respectively.

Figure 3:
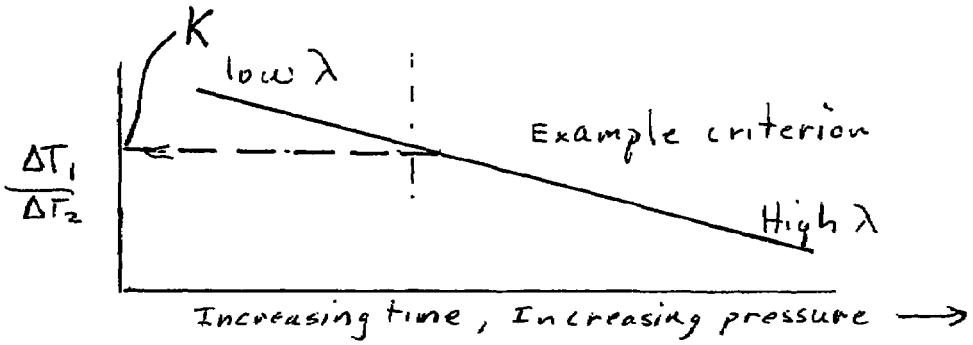
FIG. 3 is a schematic diagram showing the relationship between the ratio of temperature differences across the cabinet and across the insulation pad and the insulation performances.

In the central process unit of the appliance every ratio $\Delta T_1/\Delta T_2$ is compared to a minimum threshold value indicative of an increased pressure inside the cabinet double wall 10. In FIG. 3 there is an indication of how the heat transmission coefficient $\lambda$ changes with time, showing an increase of pressure inside the double wall. In FIG. 3 the threshold value of $\Delta T_1/\Delta T_2$ is indicated with reference K.

A technical explanation behind the above behaviour may be found in the Fourier's law for heat diffusion $q=k\times A\times\partial T/\partial n$ (for steady-state heat diffusion across the refrigerator walls), solved for one-dimensional conditions as is typically the case in domestic refrigerators where one of the dimensions (thickness) is usually much smaller then the other two (height and width). Fourier's law reveals that the temperature ratio of the differential temperatures across the vacuum wall and across a pad of standard insulation—$\Delta T_1/\Delta T_2$—can be ultimately expressed as $((k2\times l1)/(k1\times l2))$, where "k" stands for the thermal conductivity, and "/" stands for thickness.

From that, it is immediately evident that by keeping all the terms constant but $k_1$, the parameter described in the present invention to measure the insulation characteristics—again, $\Delta T_1/\Delta T_2$—will increase as $k_1$ decreases, and will decrease as $k_1$ increases, as shown in FIG. 3.

Some other observations may be made regarding the measurement system according to the present invention. Under steady state conditions, the equation $\Delta T_1/\Delta T_2$ is independent on temperatures inside the refrigerator and that of the ambient, so appropriately reflecting the variation of the "k factor" (thermal conductivity) of the vacuum insulation.

By increasing the thickness of the pad 14, or decreasing its thermal conductivity, the accuracy of value calculated by equation $\Delta T_1/\Delta T_2$ will improve. Secondly, although the proposed scheme does not depend upon the temperature history of the measured sites, it may be sensitive to transient. In order to eliminate or reduce the above side effects, it is preferred to define a trigger value for vacuum pump switching-on based on a 10% increase in k value.

This may be suitable from insulation maintenance standpoint, and could be implemented with reasonable accuracy.

Moreover it is preferred to use a "standard insulation pad" as thick as possible and with the lowest possible thermal conductivity (k) for the sake of temperature measurement accuracy. Thermistors for temperature measurement should be preferably chosen with accuracy better than 0.2° C., and door opening effect should be preferably eliminated through door sensors for awareness of "door status". As an alternative, it is possible to use the strategy of several consecutive measurements for confirming the degradation of the thermal insulation (vacuum degradation) and avoid the peaks in $\Delta T_1/\Delta T_2$ value since the door opening effect tend to be concentrated in a short period of time and vanishes quickly. If ambient temperature variation can be an issue (as for example in locations close to air conditioning/heating outlets), an external temperature sensor can help to purge those variations off the $\Delta T_1/\Delta T_2$ calculation.

The invention claimed is:

1. A vacuum insulated refrigerator cabinet comprising an evacuation system for evacuating an insulation space of the cabinet when pressure inside such space is higher than a predetermined value, said system comprising a sensor device having an insulation reference element located on one side of said insulation space and temperature sensors for assessing the differences of temperature across the insulation space and across the insulation reference element, such sensor device being suitable for providing the evacuation system with a signal related to the ratio of the above differences of temperature.

2. A vacuum insulated refrigerator cabinet according to claim 1, having such insulation reference element is located on the external side of the cabinet.

3. A vacuum insulated refrigerator cabinet according to claim 2, wherein such temperature sensors are three thermocouples located on a surface of the insulation space opposite the insulation reference element between the insulation space and the insulation reference element and on a surface of the insulation reference element opposite the insulation space.

4. A vacuum insulated refrigerator cabinet according to claim 1, wherein such temperature sensors are resistance thermometers.

5. A vacuum insulated refrigerator cabinet according to claim 4, having such temperature sensors with an accuracy at least of 0.2° C.

6. A vacuum insulated refrigerator cabinet according to claim 1, wherein such evacuation system is adapted to be triggered when the ratio of the above difference of temperature corresponds to a change in heat transfer coefficient higher than 10%.

7. Method for assessing the pressure inside an insulation space of a vacuum insulated cabinet of a refrigerator comprising the steps of evaluating the differences of temperature across the insulation space and across an insulation reference element placed on a side of such insulation space, such evaluation being carried out on the same zone of the vacuum insulated cabinet where the insulation reference element is also placed, and providing a control system of the refrigerator with a signal related to the ratio of the above differences of temperature, such ratio being indicative of pressure value inside the insulation space.

* * * * *